US005755490A

United States Patent [19]

Lamart

[11] Patent Number: 5,755,490

[45] Date of Patent: May 26, 1998

[54] OFFICE CHAIR STRUCTURE

[75] Inventor: Michel Lamart, Sarrebourg, France

[73] Assignee: Steelcase Strafor, Sarrebourg, France

[21] Appl. No.: 795,414

[22] Filed: Feb. 4, 1997

Related U.S. Application Data

[63] Continuation of PCT/FR95/01075, Aug. 10, 1995.

[51] Int. Cl. [6] ..... A47C 7/46

[52] U.S. Cl. ..... 297/353; 297/284.11; 297/337

[58] Field of Search ..... 297/218.4, 220, 297/223, 224, 228.11, 300.4, 317, 337, 353, 452.65

[56] References Cited

U.S. PATENT DOCUMENTS

| | | | |
|---|---|---|---|
| 360,622 | 4/1887 | Schults . | |
| 1,836,630 | 12/1931 | Thum . | |
| 2,221,268 | 11/1940 | Sears . | |
| 3,057,660 | 10/1962 | Schneider . | |
| 3,235,308 | 2/1966 | Conner | 297/337 |
| 3,291,527 | 12/1966 | Hall et al. . | |
| 3,446,532 | 5/1969 | Cramer . | |
| 3,554,599 | 1/1971 | Pietschmann . | |
| 3,572,829 | 3/1971 | Malitte . | |
| 3,883,173 | 5/1975 | Shephard et al. | 297/312 |
| 3,945,651 | 3/1976 | Boswinkel . | |
| 4,099,774 | 7/1978 | Sandham . | |
| 4,154,477 | 5/1979 | Swenson et al. . | |
| 4,181,357 | 1/1980 | Swenson et al. . | |
| 4,254,991 | 3/1981 | Venieris . | |
| 4,401,343 | 8/1983 | Schmidt . | |
| 4,498,702 | 2/1985 | Raftery | 297/312 |
| 4,639,039 | 1/1987 | Donovan . | |
| 4,749,230 | 6/1988 | Tornero . | |
| 5,007,678 | 4/1991 | DeKraker . | |
| 5,035,466 | 7/1991 | Mathews et al. . | |
| 5,037,158 | 8/1991 | Crawford . | |
| 5,050,931 | 9/1991 | Knoblock | 297/300.4 |
| 5,171,062 | 12/1992 | Courtois . | |
| 5,193,880 | 3/1993 | Keusch et al. . | |
| 5,295,731 | 3/1994 | Dauphin . | |
| 5,338,091 | 8/1994 | Miller | 297/218.4 |
| 5,401,077 | 3/1995 | Hosoe . | |
| 5,536,067 | 7/1996 | Pinto . | |
| 5,553,920 | 9/1996 | Meschkat et al. . | |
| 5,556,163 | 9/1996 | Rogers, III et al. . | |
| 5,597,203 | 1/1997 | Hubbard . | |
| 5,597,204 | 1/1997 | Karaus, Jr. . | |
| 5,630,650 | 5/1997 | Peterson et al. | 297/353 |

FOREIGN PATENT DOCUMENTS

| | | | |
|---|---|---|---|
| 4228637 | 3/1994 | Germany | 297/353 |
| 925337 | 5/1963 | United Kingdom | 297/353 |
| 2070920 | 9/1981 | United Kingdom | 297/353 |
| WO9011707 | 10/1990 | WIPO . | |

*Primary Examiner*—Peter R. Brown

*Attorney, Agent, or Firm*—Price, Heneveld, Cooper, DeWitt & Litton

[57] ABSTRACT

An office seat, of the type comprising, mounted so as to tilt from the front to the rear on a vertical under-frame column, an assembly that unites a base plate with a horizontal general appearance and a back with a vertical general appearance, characterized in that means are provided to permit the separate adjusting of the base plate and of the back, respectively in length and in height, relative to the assembly, as a function of the size and of the position of the user, to ensure the best possible comfort for the latter.

14 Claims, 4 Drawing Sheets

OFFICE CHAIR STRUCTURE

This is a continuation of International Application PCT/FR95/01075 filed 10 Aug. 1995, which designated the United States.

BACKGROUND

The present invention relates to a new structure for office seats and the like, of the general type that unites a generally horizontally adjustable base plate, and a generally vertically adjustable back.

In EUR-A-0 309 368, the Applicant has described such a seat in which the base plate and the back are molded as a single part, mounted so as to tilt on the under-frame by the back portion of the base plate, while the back has a structure that separately permits its controlled deformation toward the rear. Such a seat offers a group of exceptional ergonomic properties, but it is relatively complicated to execute and consequently it is costly.

The structure according to the present invention represents both a simplification of, and an improvement upon, such prior modes of execution.

SUMMARY OF THE INVENTION

To that end, according to the invention, in a seat of the general type indicated above, means are provided to permit the separate adjusting of the mentioned based plate and of the back, in length and in height respectively, relative to the indicated tilting assembly, as a function of the size and of the position of the user, in order to ensure for the latter the best comfort.

According to a preferred mode of execution of the present invention, the adjusting means comprises, for the back, in the combination of a couple of parallel slides, made in the portion of the back of the part, with corresponding small plates that project on the rear of the movable portion forming the back. For the base plate portion, the above-mentioned adjusting means comprises in the cooperation of small guiding plates for the movable base plate portion with a transverse reinforcing plate for the horizontal portion of the part.

Even more particularly, said tilting assembly comprises a single part of molded of plastic material, the latter part forms a hollow shell open upward and forward, and comprises an approximately horizontal wing and an approximately vertical wing, each one of these two wings presenting inward oriented lateral shoulders, and into which there come to slide the movable portions that respectively form the base plate and the back.

It must be well understood that by "approximately horizontal" or "of generally horizontal appearance," and "approximately vertical" or "of generally vertical appearance," reference is made to the general direction of the base plate and of the back, respectively, that of necessity are more or less slanted as a function of the degree of tilting of the assembly they are forming.

Likewise, the expression "parallel" means that said slides are spaced by a constant distance, and they can be rectilinear as well as shaped. In the case when they are rectilinear, the small plates are of any length, but in the case when they are shaped, the small plates are either relatively flexible in order constantly to follow the curvature of that shape, or relatively short, in order to follow the curvature without any deformation.

The adjusting of the total length of the base plate and of the total height of the back, therefore, results from the degree of sliding forward or backward, and upward or downward, respectively, of the movable portions, relative to the tilting assembly, that is considered as fixed in this respect, even though it tilts relative to the under-frame.

This sliding may occur by a simple traction or push exerted in the desired direction on the movable portion under consideration. Once the desired position has been reached, it is necessary to block this portion in that position, by means of a pivoting eccentric cam for example, governed by a lever. This is especially the case for the movable portion of the base plate.

In the case of the movable portion of the back, the invention relates to an especially simple and efficient positive governing element. To that end, on the "back" portion of the assembly, that is to say the fixed vertical external face, there can move a cursor along an approximately horizontal guide, while the end of this cursor that projects inward runs through an obliquely made slit in the movable portion. By horizontally displacing this cursor, the latter exerts on said slit an action with a vertical component that causes the vertical displacement of the movable portion, and that blocks this displacement at any desired lever, or step by step, depending on the profile of said slit.

Other governing means could be used, such as a pinion-rack system for example, but at the expense of the low cost of this material that is simple by definition.

The guiding of the displacement of the movable portions essentially is ensured by the cooperation of the aforementioned adjusting means. It may find itself completed once the movable portions have a certain volume and as it will be explained below, by the guiding provided by the inward oriented shoulders of the molded shell that constitutes the tilting assembly on the external and generally material covered external surface of the movable portions, for which they form an aesthetic frame.

The invention further relates to an additional improvement the purpose of which is to increase the comfort of these seats. Indeed, at the time of the rearward tilting of the base plate/"fixed" back assembly, the base plate portion tends to move upward, this possibly creating some discomfort at the level of the knees. In order to prevent this stress, there is provided, according to the present invention, to have, in the movable portion of the base plate, a front part that is maintained horizontal by sliding over an extension of the fixed under-frame, thanks to a zone of said movable portion that forms a hinge. Taking into account the relatively limited clearance that results from the tilting, said anterior part hardly rises at all, whatever may be the degree of sliding of that movable portion of the base plate.

Finally, according to an important characteristic of the invention, said sliding movable portions of the base plate and of the back, instead of being made by injection or heat-forming as was the custom until now and a process that creates hard and uncomfortable pieces, are made by the so-called extrusion-blowing technique that creates hollow volumes with relatively flexible walls that can be adapted in thickness so that in this way these portions constitute comfortable "pillows." Furthermore, the quantity of material used to execute such pillows proportionally is less important than to execute the solid pieces obtained by injection, whence there results an appreciable saving.

In such a case, it is further advantageous, according to the present invention, to create on the lateral peripheral surface of the hollow movable portions, grooves that permit the setting into place, on the anterior face of these portions, of a covering (upholstering) element by means of a simple tightening rope, a process more simple than the stapling technique, required by the thinner injected pieces.

Other details, characteristics and advantages of the invention will be seen in the following description of one preferred mode of execution, that corresponds to the attached drawings.

DETAILED DESCRIPTION OF EMBODIMENTS

In the group of FIGS. 1–7, the elements of the system according to the invention have been respectively designated:

A: A movable base plate or seat whether it is "upholstered" or not.

D: A movable back, whether it is "upholstered" or not, and

C: A hollow shell meant to receive the base plate A and the back D.

This assembly is mounted in a tiling or stacked manner on the vertical column of a classic under-frame that does not constitute a part of the present invention.

Figure 1:
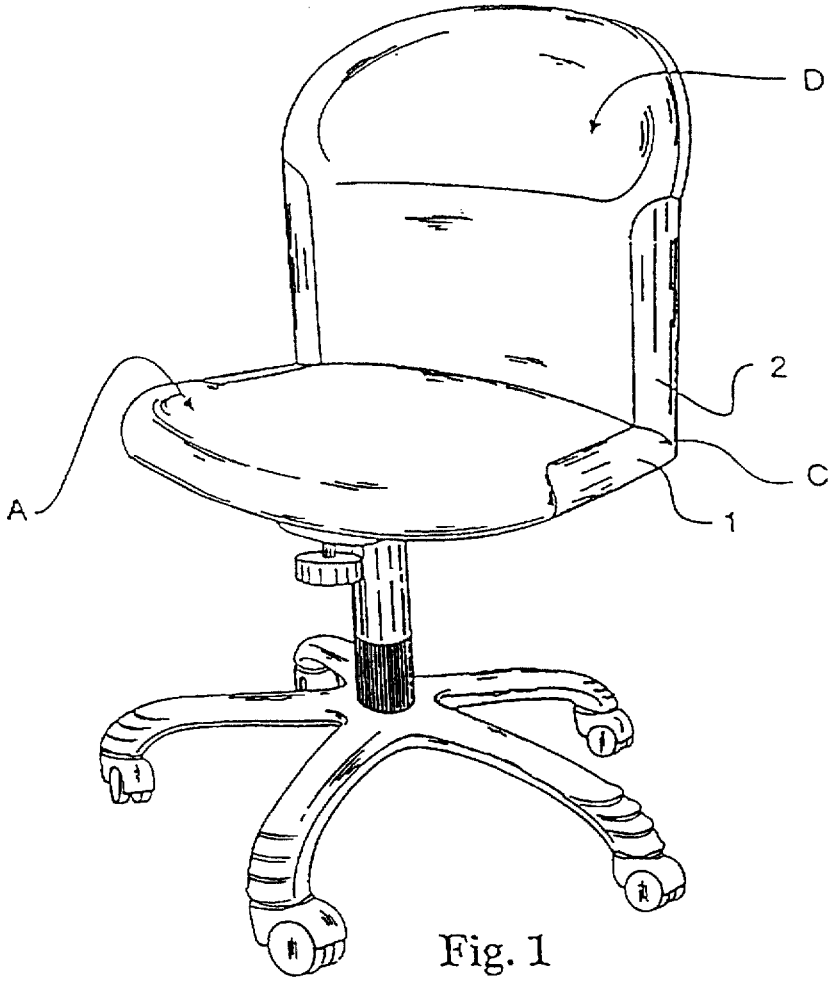
FIGS. 1 and 2 are face and profile views, respectively, of the shell assembly with of the "upholstered" base plate and back in place, and FIG. 1' is a view of the back of the same assembly, taken from below.
Figure 1:
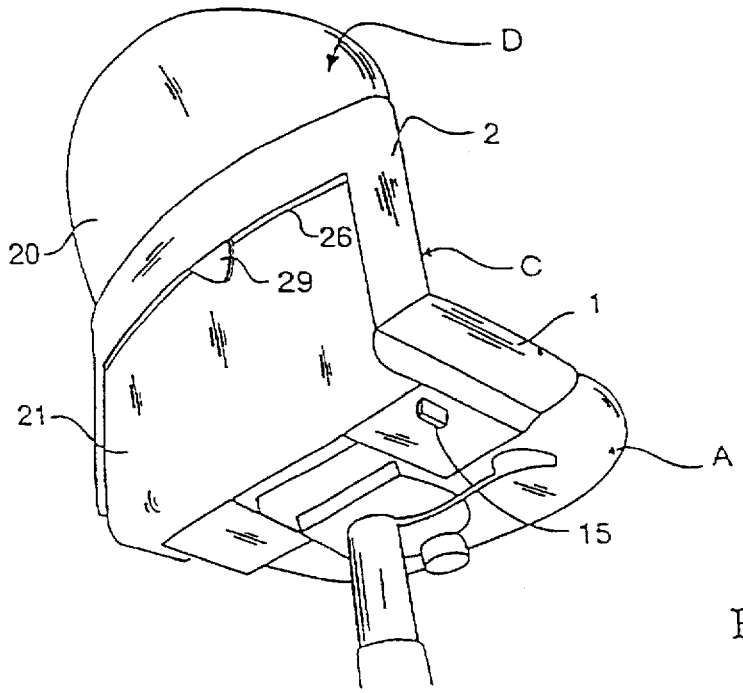

As clearly shown in FIGS. 1' and 3, the shell C is a single molded part that is comprised of a horizontal portion 1 and of a vertical portion 2, shown here approximately perpendicular to each other.

Each one of the portions 1 and 2 comprises a back or bottom, respectively 1' and 2', and rounded shoulders or wings, namely 3 for the horizontal portion 1, and 4 for the vertical portion 2. The curvature of these wings is oriented toward the inside of the seat, and their thickness of adapted to the thickness of the seat A and of the back D in the "upholstered" state, as explained in more detail below.

Figure 2:
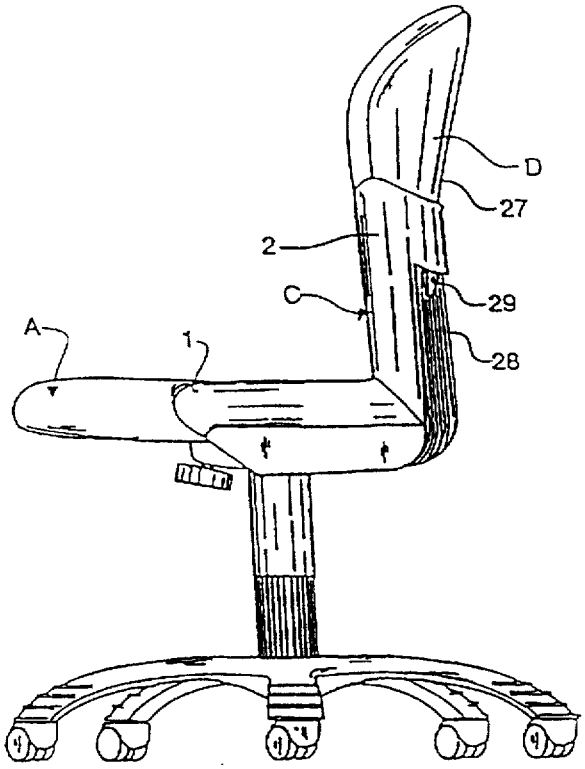
Figure 3:
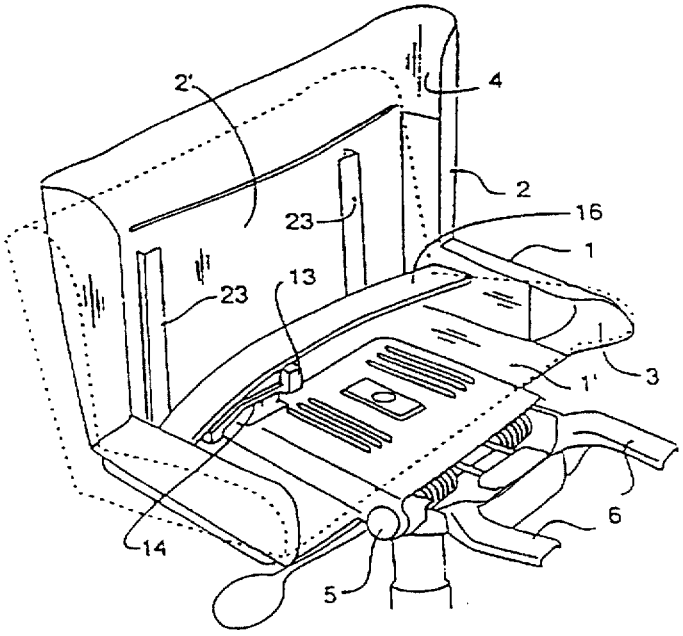
FIG. 3 is a front view of the shell alone.
Figure 6:
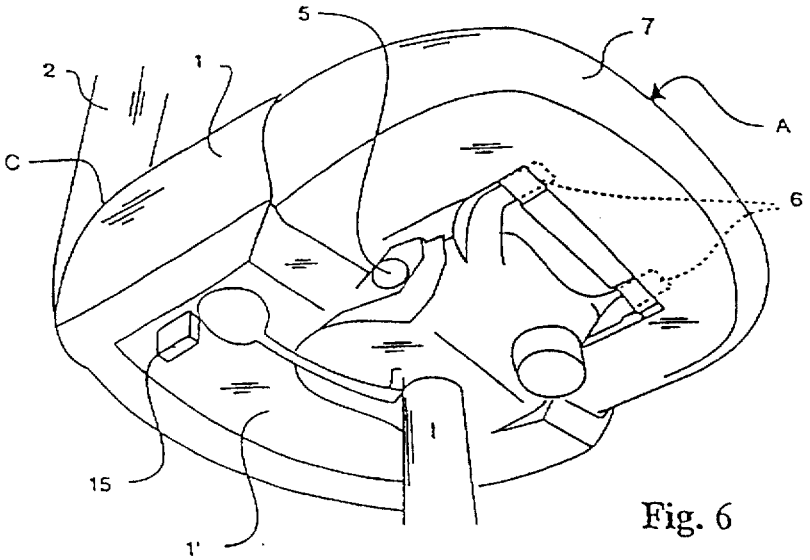
Figure 7:
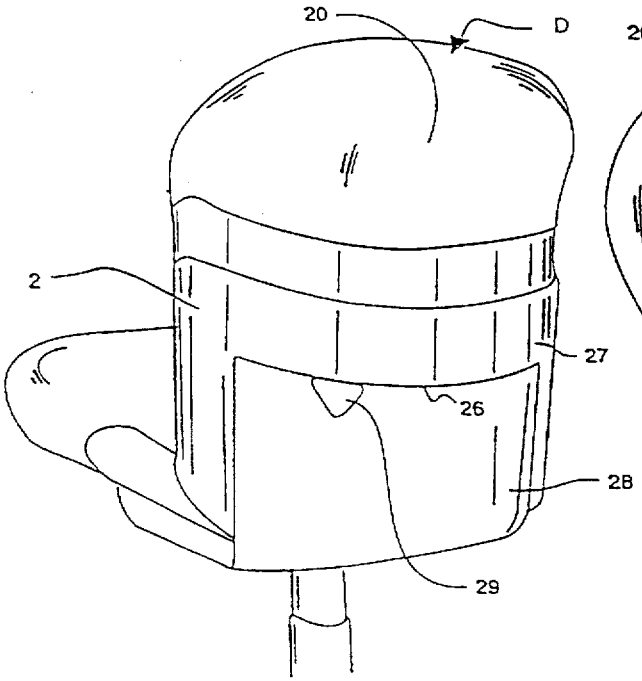
FIGS. 7 and 8 are, seen from behind, the non-upholstered back by itself and set into place, respectively.

As it appears especially in FIGS. 2, 3, and 6, the back or bottom 1' of the horizontal portion 1 of shell C is affixed to the tilting element located in the upper part of the under-frame column, this tilting element tilts by elastically pivoting around a horizontal shaft 5 (FIGS. 3 and 6). Besides, on the upper part of said column, there are mounted a couple of fixed horizontal profiles 6 (FIG. 3) located to the fore relative to the bottom part 1".

By means of this arrangement, the entire shell C can tilt rearward as indicated by a broken line in FIG. 3, while the profiles 6 remain horizontal.

Figure 4:
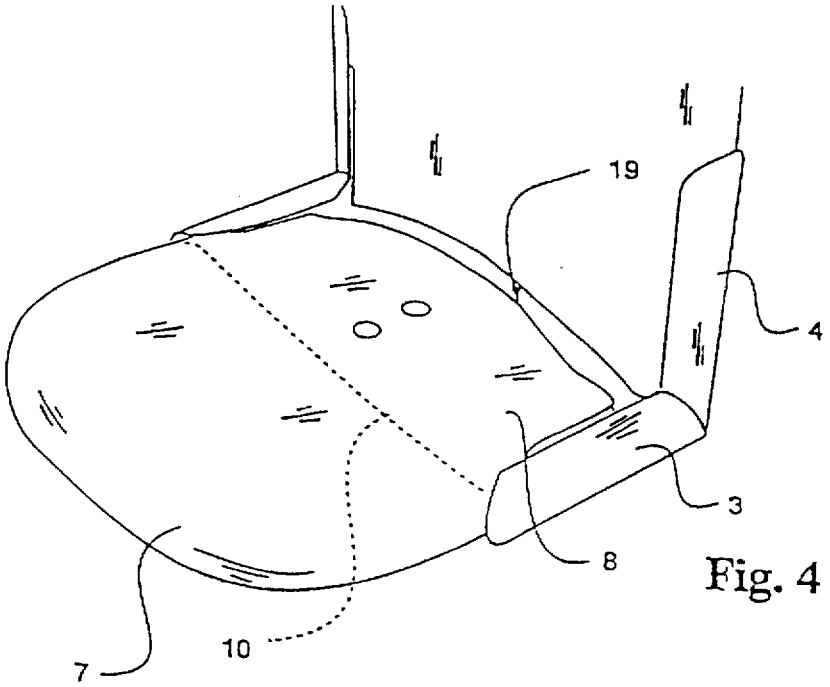
FIG. 4 is a view from above, of the non-upholstered base plate seen in place.
Figure 5:
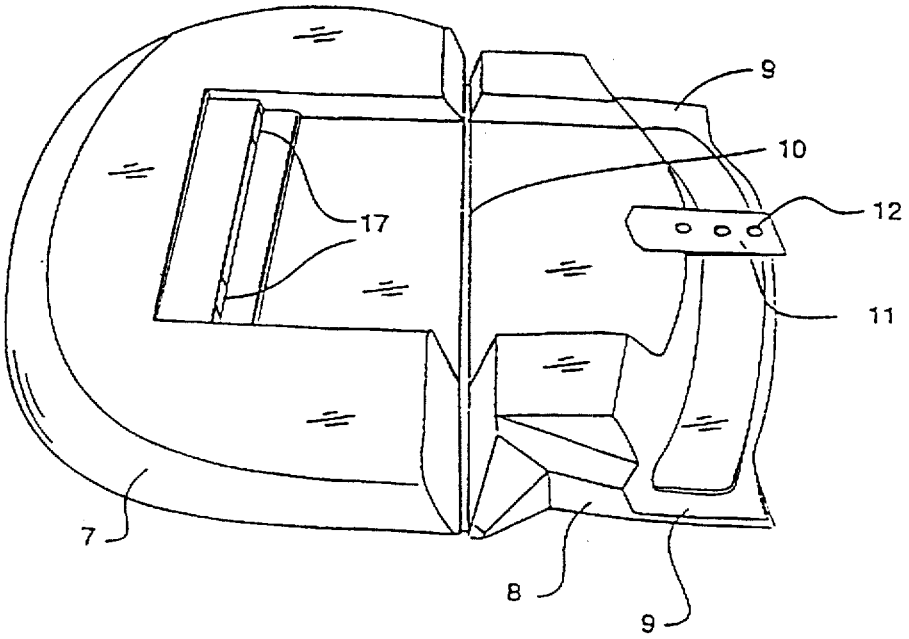
FIGS. 5 and 6 are under-views of the non-upholstered base plate, by itself and set into place, respectively.

In the horizontal portion 1 of the shell C there comes to fit the movable base plate A, as shown in FIGS. 4, 5, and 6.

This movable base plate is composed of a fore portion 7 forming a "pillow," preferably obtained by the extrusion-blowing technique, and of a rear portion 8 that comprises lateral small plates 9 and is connected to the fore portion 7 by a relatively thin zone 10 that constitutes a hinge between the two portions.

Under the surface of the rear portion 8 there is provided a tab 11 having a series of openings or ports 12 (FIG. 5) meant for adjusting the position of seat A by means of a half dog 13 carried by a lever 14 mounted pivoting around a horizontal shaft and that can be maneuvered from the outside by means of a knob 15 (FIGS. 1' and 3).

The base plate A is inserted into the horizontal portion 1 of the shell C, as seen in FIGS. 4 and 6, the small guiding plates 9 following the internal face of the shoulders 3 and the transverse reinforcing plate 16, and the fore portion 7 being enveloped by said shoulders 3, while the profiles 6 come to lodge themselves inside perforations 17 provided in the thickness of said fore portion 7, in such manner that the thin zone 10 comes to place itself approximately near the front edge of the bottom part 1', depending on the adjusting of the seat A.

The base plate A thus is mounted sliding from the front to the rear in the horizontal portion 1 of shell C, the degree of this sliding depending on which one of the openings or ports 12 the half dog 13 is inserted into, and the guiding of this sliding being ensured, on the rear part by the shoulders 3 of the horizontal portion 1 of shell C and, on the fore part, by the sliding of the profiles 6 into perforations 17.

According to an interesting characteristic of the present invention, the comfort of the user is ensured both regardless of this degree of sliding forward or backward, and regardless of the degree of backward tilting of shell C, thanks to the thin zone 10 that ensures the transition between the horizontal part fixed by the profiles 6 and the tilting part, defined by the shoulders 3.

As seen in FIG. 4, a rearward run of the base plate A is limited so as to permit a certain play 19 to remain, in order to allow passage for the back D after same has been upholstered.

According to an important characteristic of the invention, said back D is movable in height, independently of base plate A.

To that end, as seen in FIG. 3, said back F comprises an upper portion 20 and a lower portion 21.

The upper portion 20 is executed by extrusion-blowing in the form of a "pillow" the shape of which corresponds to that of the shoulders 4 of the vertical portion 2 of shell C, the lower portion 21, also made by extrusion-blowing comprising, made by molding and projecting on its rear face, male parts or small plates 22 that come to slide inside corresponding grooves 23 of the front face of said vertical portion 2 of shell C (FIG. 3).

The guiding for the sliding of back D, thus, is ensured both by the shoulders 4 and the grooves 23.

Figure 8:
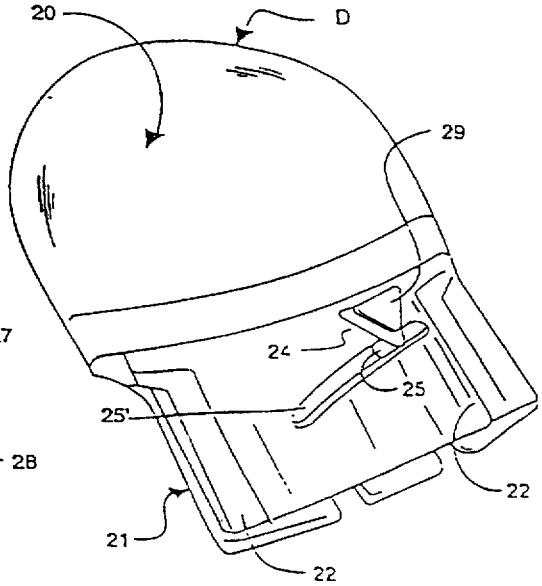

The adjusting in height of this sliding is obtained by an original system, made up of a cursor 24, with a horizontal pin 25 that is mounted sliding in an oblique groove 25' made in the rear face of the back D, and of a horizontal slide 26 resulting from a shift between the upper portion 27 and lower portion 28 of the rear face of back or bottom 2' of the vertical portion 2 of shell C, as seen in FIGS. 2 and 8. The knob 29 of cursor 24, that comes as one piece with pin 25, has a reversed U-shaped vertical section, the bottom of which rests on the upper edge of said lower portion 28 and is guided by the lower edge of said upper portion 27, so that cursor 24 can move horizontally only, and only in this same horizontal displacement, but that, during this same horizontal displacement, the pin 25, exerting a pressure on the upper or lower edge, respectively of groove 25', forces the back D to rise or descend, respectively, while remaining vertically guided by the shoulders 4 and the grooves 23.

Of course, as does seat A, the back D is meant to be "upholstered," that is to say covered with a certain thickness of a decorative woven material. It is for this reason that the base plate A is mounted in the horizontal portion of the shell C with a certain play 19 in its rear (FIG. 4).

The preceding description is given as an example of execution of the present invention, and it is well understood that this example has no limitative character, especially with respect to the precise shape or to the dimensions of the various elements of the system that constitutes the invention.

Especially, this system is applicable, not only to chairs, as shown, but to armchairs comprising arms or under-frames with different degrees of tilting. It is also applicable to seats of the sleigh type, in which is the base plate is not tilting and in which the hinge 10 portion of member A is no longer useful. The invention also relates, as an independent characteristic, to a system that adjusts the back in height alone.

The invention thus is defined by the following claims.

I claim:

1. A chair comprising:

a base;

a shell mounted on the base and having a vertical portion and a horizontal portion;

a back slidably mounted on the vertical portion;

a seat slidably mounted on the horizontal portion; and wherein said back includes a slit, and the shell includes a generally horizontal guide, and including an adjustment device with a slit-engaging and guide-engaging adjustment member operably mounted on said vertical portion for operably engaging the slit, one of the slit and the generally horizontal guide being at an angle to horizontal so that upon adjustment of the adjustment member, the back is adjusted vertically.

2. The chair defined in claim 1, wherein the vertical portion defines a second guide, and wherein the back slidably engages the second guide.

3. The chair defined in claim 2, wherein the vertical portion includes configured side edges forming said second guide.

4. The chair defined in claim 3, wherein the horizontal portion includes configured side edges forming a third guide, and wherein the seat slidably engages the third guide.

5. The chair defined in claim 1, wherein the horizontal portion defines a second guide, and wherein the seat slidably engages the second guide.

6. The chair defined in claim 5, wherein the horizontal portion includes configured side edges forming said second guide.

7. The chair defined in claim 1, wherein the seat includes an apertured flange, and wherein the shell includes an adjustment device for operably engaging the apertured flange to control positioning of the seat.

8. The chair defined in claim 1, wherein the seat includes front section and a rear section connected by a hinge, and wherein the base includes a pair of arms that extend forwardly under the front section for supporting the front section.

9. The chair defined in claim 8, wherein the base includes a spring for resiliently supporting the arms and for biasing the arms upwardly.

10. An office chair comprising:

a seat having a base plate that extends generally horizontally;

a back that extends generally vertically;

a shell adjustably supporting the seat and the back in a manner permitting separate adjustment of said budge plate and of said back, respectively, in length and in height relative to said shell as a function of the size and of the position of a seated user, said shell including a first adjusting member located at a bottom of said shell, and further including a governing lever pivotally mounted on the bottom of the shell; and said base plate including a tab with perforations therein, the governing lever including a pin selectively engageable with the perforations for locking the seat in a selected adjusted position on the shell.

11. A chair according to claim 10 wherein each of the base plate and back comprise a blow-molded part having flexible walls and a hollow volume, the flexible walls having a thickness suitable to provide a flexibility that ensures the best comfort for the seated user.

12. An office chair comprising:

a seat having a base plate that extends generally horizontally;

a back that extends generally vertically;

a shell adjustably supporting the seat and the back in a manner permitting separate adjustment of said base plate and of said back, respectively, in length and in height relative to said shell as a function of the size and of the position of a seated user;

the back including a non-horizontal angled slit and the shell including a guide that extends approximately horizontally; and a handle movably mounted in an external face of the back that operably engages the guide and the slit, so that horizontal displacement of the cursor causes a vertical displacement of the back.

13. A chair according to claim 12 wherein the base plate includes a rear part and a fore part connected to the rear part by a horizontal hinge-forming zone so that, when the seat is adjusted, the fore part flexes to prevent any stress under the knees of the seated user at the time of rearward tilting of the back.

14. A chair according to claim 12 wherein each of the base plate and back comprise a blow-molded part having flexible walls and a hollow volume, the flexible walls having a thickness suitable to provide a flexibility that ensures the best comfort for the seated user.

* * * * *

UNITED STATES PATENT AND TRADEMARK OFFICE

CERTIFICATE OF CORRECTION

PATENT NO. : 5,755,490
DATED : May 26, 1998
INVENTOR(S) : Michel Lamart

It is certified that error appears in the above-identified patent and that said Letters Patent is hereby corrected as shown below:

On the title page, item

[73] Assignee: Steelcase Strafor, Sarrebourg, France should be --[73] Assignee: Steelcase Strafor, Strasbourg, France--.

Column 1, Line 1;

"OFFICE CHAIR STRUCTURE" should be --NOVEL OFFICE CHAIR STRUCTURE--.

Column 6, Claim 10, Line 10;

"budge" should be --base--.

Signed and Sealed this

Sixteenth Day of February, 1999

*Attest:*

*Attesting Officer*

*Acting Commissioner of Patents and Trademarks*